US008430649B2

(12) United States Patent
Albers et al.

(10) Patent No.: US 8,430,649 B2
(45) Date of Patent: Apr. 30, 2013

(54) COMPENSATOR ASSEMBLY FOR SUBMERSIBLE PUMP SYSTEM

(75) Inventors: Thomas Albers, Ahrensburg (DE); Axel Helmut Tank-Langenau, Remmels (DE); Behrend Goswin Schlenhoff, Hamburg (DE)

(73) Assignee: Flowserve Management Company, Irving, TX (US)

( * ) Notice: Subject to any disclaimer, the term of this patent is extended or adjusted under 35 U.S.C. 154(b) by 762 days.

(21) Appl. No.: 12/622,831

(22) Filed: Nov. 20, 2009

(65) Prior Publication Data

US 2011/0123374 A1 May 26, 2011

(51) Int. Cl.
*F04B 35/04* (2006.01)

(52) U.S. Cl.
USPC ..... 417/414; 310/87

(58) Field of Classification Search ..... 417/414; 310/87
See application file for complete search history.

(56) References Cited

U.S. PATENT DOCUMENTS

| | | | | |
|---|---|---|---|---|
| 3,947,709 | A | 3/1976 | Waltman | |
| 4,583,923 | A | 4/1986 | James | |
| 4,992,689 | A * | 2/1991 | Bookout | 310/87 |
| 6,029,539 | A * | 2/2000 | Young | 74/574.3 |
| 6,242,829 | B1 | 6/2001 | Scarsdale | |
| 7,806,670 | B2 * | 10/2010 | Du et al. | 417/414 |
| 2004/0146415 | A1 | 7/2004 | Merrill et al. | |
| 2007/0074872 | A1 | 4/2007 | Du et al. | |
| 2007/0207046 | A1 * | 9/2007 | Du et al. | 417/423.3 |

* cited by examiner

*Primary Examiner* — Charles Freay
*Assistant Examiner* — Patrick Hamo
(74) *Attorney, Agent, or Firm* — Dinsmore & Shohl LLP

(57) ABSTRACT

A submersible pump system with a pump, motor and compensator assembly. In one embodiment, the compensator assembly is made up of multiple elastomeric compensators and a housing. The elastomeric compensators, which are made up of an engaging end, a floating end and a series of alternating crests and grooves, may contain motor cooling liquid. The crests and grooves extend along the compensator's longitudinal axis. The compensators possess a degree of elasticity sufficient for a width of at least one of the respective grooves to expand and contract along with the motor cooling liquid. The crests slide along an interior wall of the housing, while the floating end moves within the housing in cooperation with expansion and contraction of the width of at least one of the grooves.

20 Claims, 8 Drawing Sheets

COMPENSATOR ASSEMBLY FOR SUBMERSIBLE PUMP SYSTEM

BACKGROUND OF THE INVENTION

The present invention relates generally to compensator assembly, and more particularly to submersible pump systems using one or more such compensator assemblies.

Deep-well submersible (DWS) pumping systems (also referred to as electric submersible pumps (ESP), or more simply, submersible pumps) are especially useful in extracting valuable resources such as oil, gas and water from deep well geological formations. In one particular operation, a DWS pump unit can be used to retrieve geothermal resources, such as hot water, from significant subterranean depths. Submersible pumps are driven by attached motors and generally are operable in a variety of applications in which typically both the pump and the motor are completely submersed in a well. Because submersible pumps are relatively inaccessible (often completely submerged at distances between about 400 and 700 meters beneath the earth's surface), they must be able to run for extended periods without requiring maintenance. In addition, they must be able to transfer away the significant amount of heat that is generated through mechanical and electrical losses in the pump and motor. To do that, a cooling liquid (usually oil or water) is used to fill an interior of the motor. The cooling liquid typically absorbs the heat from the motor and transfers it to the surrounding liquid in the well.

The motors of submersible pumps typically utilize a compensator that is generally connected to the motor. Ideally, the compensator performs several functions that contribute to the reliable operation of the motor, including providing for thermal expansion of the motor cooling liquid during motor operation, and balancing motor interior and exterior pressures. Conventional compensators typically are made from rubber, which are resilient and heat resistant in only limited temperature regimes, for example, up to about 110° C. By contrast, geothermal and related deep well applications may encounter temperatures of the fluid being pumped at between 120° and 160° C. Moreover, rubber compensators generally have only one maximum size due to the manufacturing or production processes. This maximum size generally is too small for high power submersible pump applications in high temperature environments (i.e., exceeding 110° C.), and is likewise not feasible for extensions or other situations where modular combinations of multiple compensators may be required. As such, there exists a need for a modular compensator operable in high temperature and high pressure environments such as those encountered in submersible pump applications.

SUMMARY OF THE INVENTION

It is against the above background that embodiments of the present invention provide compensator assemblies for submersible pump systems operable in high temperature and high pressure environments. In accordance with one embodiment of the present invention, a submersible pump system comprises a submersible pump, a submersible motor, and a compensator assembly. The compensator assembly comprises a longitudinally extending compensator and a compensator housing. The compensator is used to contain a motor cooling liquid, while the housing contains the compensator. A conveying tube is partially insertable into each of the submersible motor and the compensator to allow fluid communication of the motor cooling liquid between them. The compensator housing includes a connecting (proximal) end and a remote end opposite the connecting end. The connecting end is engageable with the submersible motor to allow the two to be secured to one another. The compensator, which is situated along at least a portion of the length of the compensator housing, defines an engaging end and a floating end, where the former can engage (through a flange or related connector) the conveying tube, while the floating end is free to longitudinally expand and contract in response to changes in motor cooling fluid presence in the compensator housing. The compensator includes a series of alternating crests and grooves such that the compensator generally defines a bellows-like (or accordion-like) structure extending along its longitudinal axis. Further, the compensator comprises a degree of elasticity sufficient for a width of at least one of the grooves to expand and contract with thermal expansion and contraction, respectively, of the motor cooling liquid contained therein. The crests contact an interior wall of the compensator housing with a coefficient of friction that is insufficient to prevent a sliding of the crests along the interior wall and movement of the floating end relative to the engaging end with expansion and contraction of the width of the at least one of the grooves. The conveying tube received by the engaging end defines a point of maximum contraction of the compensator past which the floating end cannot move. An end of the compensator housing opposite of the connecting end defines a point of maximum expansion of the compensator past which the floating end cannot move.

Optionally, the compensator housing may substantially restrict expansion and contraction of the compensator to along the longitudinal axis. The floating end of the compensator may be sealed to prevent passage of motor cooling liquid therethrough or may be at least partially open to permit passage of motor cooling liquid therethrough and operable to engage an engaging end of another compensator. The compensator assembly may further comprise a securing device to secure an engagement between the floating end and the engaging end of the other compensator. The compensator may be configured primarily of polytetrafluoroethylene (PTFE) and may comprise a heat resistance of at least about 260° C., while the compensator housing is configured primarily of metal. In such case where PTFE or a related elastomeric material is used, the compensator is considered to be an elastomeric compensator. In another option, the compensator may further comprise a drain plug to allow motor cooling liquid to be drained. The compensator housing may further comprise a housing drain plug to enable the draining of motor cooling liquid therefrom. The compensator assembly may further comprise a pressure balancing line operable to control release of over-pressurized air (or other gaseous fluid) from within the compensator housing to outside of the compensator housing.

In accordance with another embodiment, a submersible pump system comprises a submersible pump, a submersible motor and a compensator assembly, wherein the compensator assembly comprises multiple longitudinally extending elastomeric compensators to contain a motor cooling liquid, a compensator housing to enclose the elastomeric compensators, and at least one securing device. The compensator housing comprises a flange and a conveying tube, the flange disposed proximally to a connecting end of the compensator housing to connect to a port of the submersible motor and the conveying tube partially insertable into each of the port of the submersible motor and a first of the elastomeric compensators to convey a motor cooling liquid there-between. The elastomeric compensators respectively comprise an engaging end to engage the flange, a floating end to float within the compensator housing, and a series of alternating crests and grooves extending annularly at least partially along a longitudinal axis of the respective elastomeric compensator. The floating end of the first elastomeric compensator is at least partially open to permit passage of motor cooling liquid therethrough and is operable to engage the engaging end of a second elastomeric compensator and the securing device is operable to secure an engagement between the first elastomeric compensator and the second elastomeric compensator. The elastomeric compensators respectively comprise a degree of elasticity sufficient for a width of at least one of the respective grooves to expand and contract with thermal expansion and contraction, respectively, of the motor cooling liquid contained therein. The respective crests contact an interior wall of the compensator housing with a coefficient of friction there-between insufficient to prevent a sliding of the respective crests along the interior wall and movement of the respective floating ends relative to the engaging end of the first elastomeric compensator with expansion and contraction of the width of the at least one of the grooves. The conveying tube received by the engaging end of the first elastomeric compensator defines a point of maximum contraction of the elastomeric compensators past which the floating end of the first elastomeric compensator cannot move. An end of the compensator housing opposite of the connecting end defines a point of maximum expansion of the elastomeric compensators past which the floating end of the second elastomeric compensator cannot move.

Optionally, the floating end of the second elastomeric compensator may be sealed to prevent passage of motor cooling liquid therethrough. At least one of the elastomeric compensators may further comprise a drain plug to drain motor cooling liquid from the elastomeric compensator.

In accordance with yet another embodiment, a compensator assembly comprises multiple longitudinally extending elastomeric compensators, a compensator housing, and at least one securing device. The compensator housing is operable to enclose the elastomeric compensators and comprises a flange and a conveying tube, the flange disposed proximally to a connecting end of the compensator housing to connect to a port of a motor and the conveying tube partially insertable into each of the port of the motor and a first of the elastomeric compensators to convey a motor cooling liquid there-between. The elastomeric compensators respectively comprise an engaging end to engage the flange, a floating end to float within the compensator housing, and a series of alternating crests and grooves extending annularly at least partially along a longitudinal axis of the respective elastomeric compensator. The floating end of the first elastomeric compensator is at least partially open to permit passage of motor cooling liquid therethrough and is operable to engage the engaging end of a second elastomeric compensator. The securing device is operable to secure an engagement between the first elastomeric compensator and the second elastomeric compensator. The elastomeric compensators respectively comprise a degree of elasticity sufficient for a width of at least one of the respective grooves to expand and contract with thermal expansion and contraction, respectively, of the motor cooling liquid contained therein. The respective crests contact an interior wall of the compensator housing with a coefficient of friction there-between insufficient to prevent a sliding of the respective crests along the interior wall and movement of the respective floating ends relative to the engaging end of the first elastomeric compensator with expansion and contraction of the width of the at least one of the grooves. The conveying tube received by the engaging end of the first elastomeric compensator defines a point of maximum contraction of the elastomeric compensators past which the floating end of the first elastomeric compensator cannot move. An end of the compensator housing opposite of the connecting end defines a point of maximum expansion of the elastomeric compensators past which the floating end of the second elastomeric compensator cannot move.

BRIEF DESCRIPTION OF THE DRAWINGS

The following detailed description of specific embodiments can be best understood when read in conjunction with the following drawings, where like structure is indicated with like reference numerals and in which.

Figure 1:
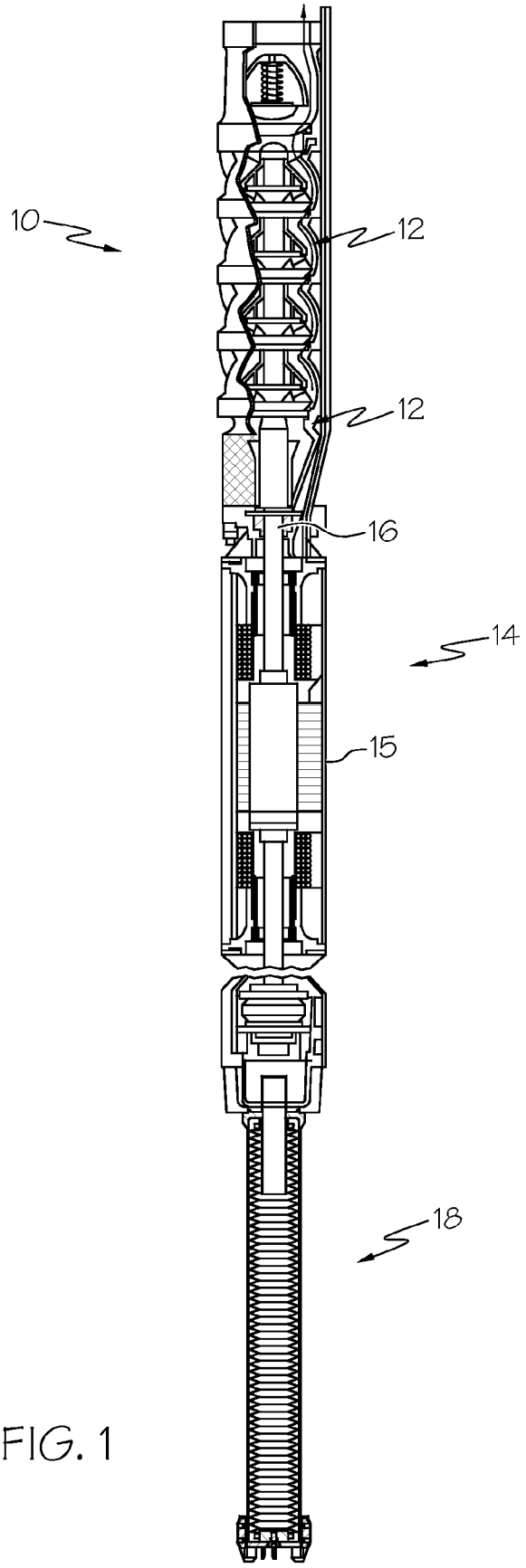
FIG. 1 is a cross-sectional view of a submersible pump system with a compensator assembly according to one embodiment of the present invention.

The embodiments set forth in the drawings are illustrative in nature and are not intended to be limiting of the embodiments defined by the claims. Moreover, individual aspects of the drawings and the embodiments will be more fully apparent and understood in view of the detailed description that follows.

DETAILED DESCRIPTION OF THE PREFERRED EMBODIMENTS

Referring initially to FIG. 1, a submersible pump system 10 generally comprises a submersible pump 12 (shown presently as a plurality of impeller modules, although described herein in the singular), a submersible motor 14, a drive shaft 16, and a compensator assembly 18. The pump 12 may be any conventional submersible pump known in the art, while the motor 14 is any motor operable when submersed in a liquid and capable of driving the pump 12 in order to propel the liquid being pumped to a higher elevation. As used herein, "submersible motor" refers generally to a motor enclosed by a motor housing 15 filled substantially with a motor cooling liquid. Likewise, in the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference while still preserving the basic function of the subject matter at issue.

In a preferred form, the motor 14 is an electric motor that comprises at least one stator that drives rotation of at least one rotor where, such as an induction motor or related well-known device. Such rotation of the rotor by the stator generates heat within the motor 14. A motor cooling liquid typically is provided to the motor 14 to absorb and remove heat from the motor 14, in particular the stators. Such liquid may also perform motor lubricating and electrical insulation functions, and as such may be a motor oil with appropriate dielectric properties. Examples of such multifunction fluids include water (in situations where electrical insulation isn't needed), which works as coolant and lubricant, and oil for situations where electrical insulation is needed that can also serve as coolant and lubricant. Given the high-temperature regimes expected to be encountered in geothermal applications in general and DWS applications in particular, where as discussed above, such temperatures of the fluid being pumped are between 120° and 160° C., coupled with the high heat loads being imparted to the motor 14 due to mechanical losses, the compensator of the present invention needs to work in a significantly higher temperature environment than that previously encountered. In the present context, the motor cooling fluid will generally include such lubricating functions, and such attributes will accordingly be inferred. The drive shaft 16, which also may be any conventional drive shaft known in the art, connects the motor 14 and the pump 12. Because the rotor is part of (or is otherwise connected to) drive shaft 16, the rotation induced in the rotor by the stator in the motor 14 causes the drive shaft 16 to spin, which in turn drives the pump 12 and the resultant propulsion of the liquid.

As described above, the compensator assembly 18 generally promotes reliable operation and a longer functional life of the motor 14. For example, the compensator assembly 18 can accommodate thermal expansion of the motor cooling liquid during motor 14 operation and may compensate for pressure applied to an exterior surface of the motor 14 by the surrounding environment by acting as a medium for the transfer of the external pressure to the interior of the motor 14. Such pressure compensation is especially beneficial in dynamic pressure circumstances, where the pressure inside the motor 14 is fluctuating. As such, the compensator assembly 18 has the effect of eliminating, or at least significantly reducing, the pressure differential between the interior of the motor 14 and the external subsurface environment.

Figure 2A:
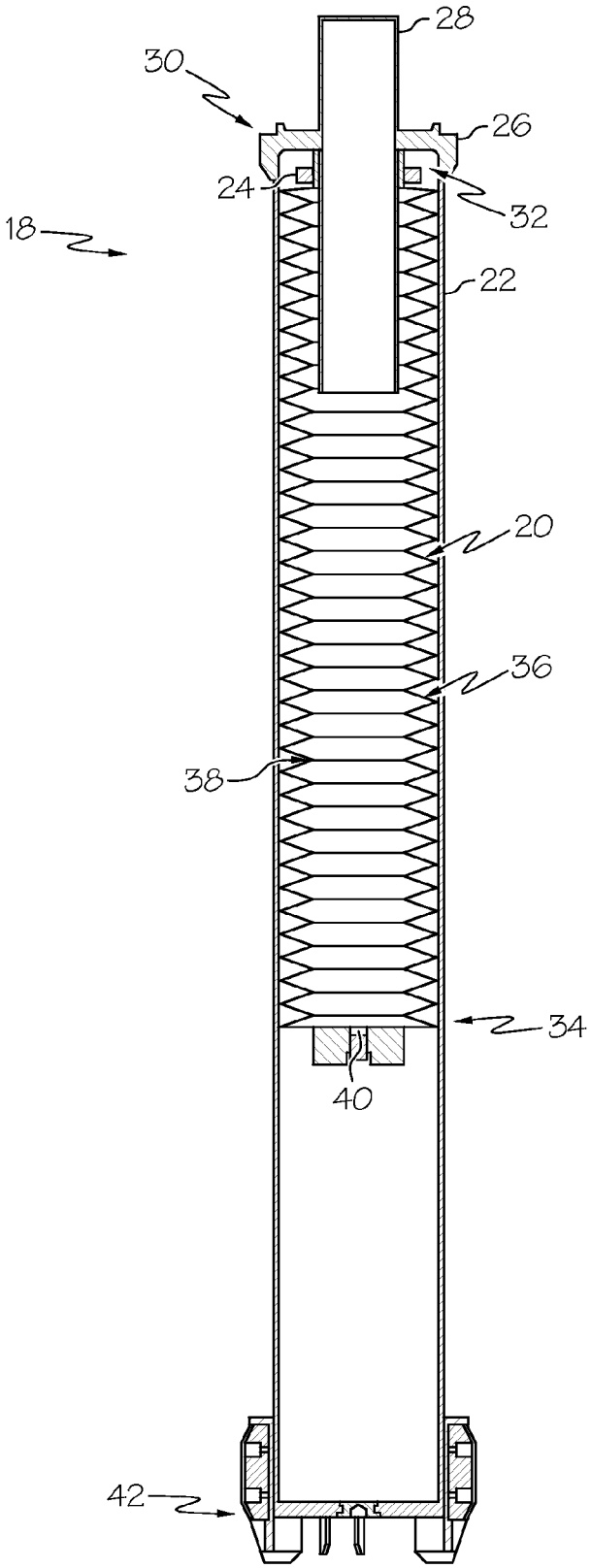
FIG. 2A is a cross-sectional view of a compensator assembly according to another embodiment of the present invention.
Figure 2B:
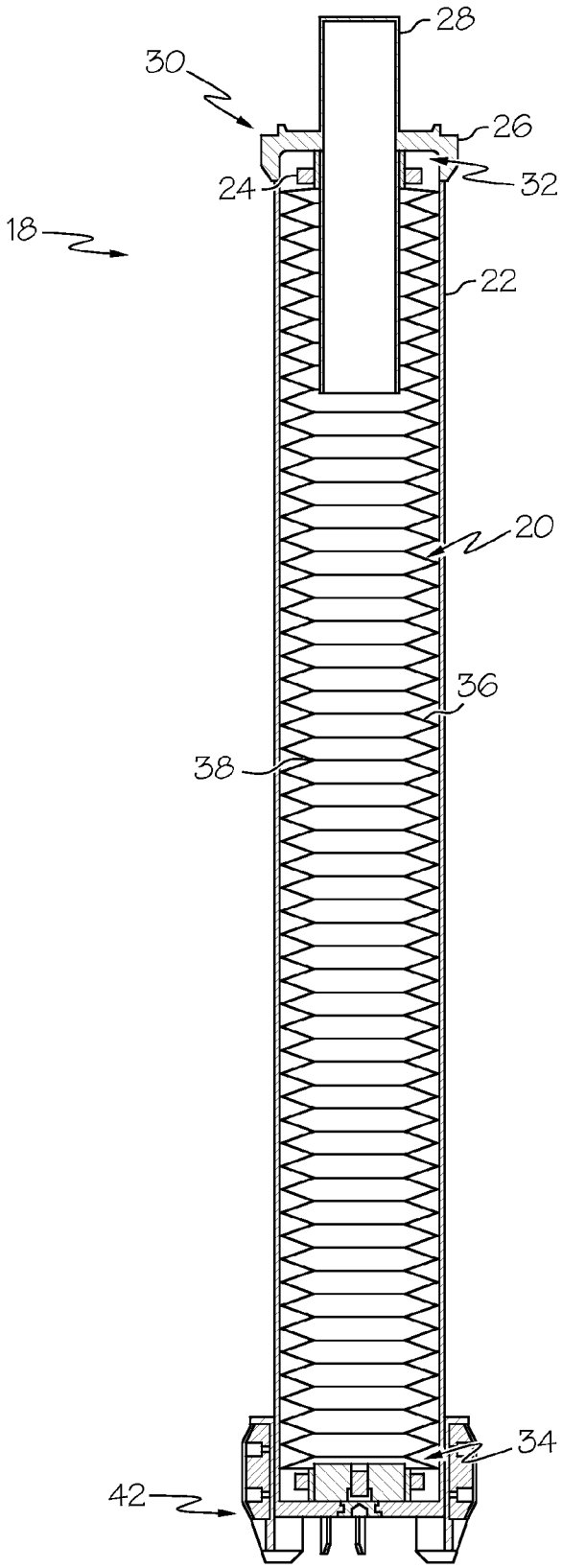
FIG. 2B is a cross-sectional view of a compensator assembly according to another embodiment of the present invention.
Figure 3:
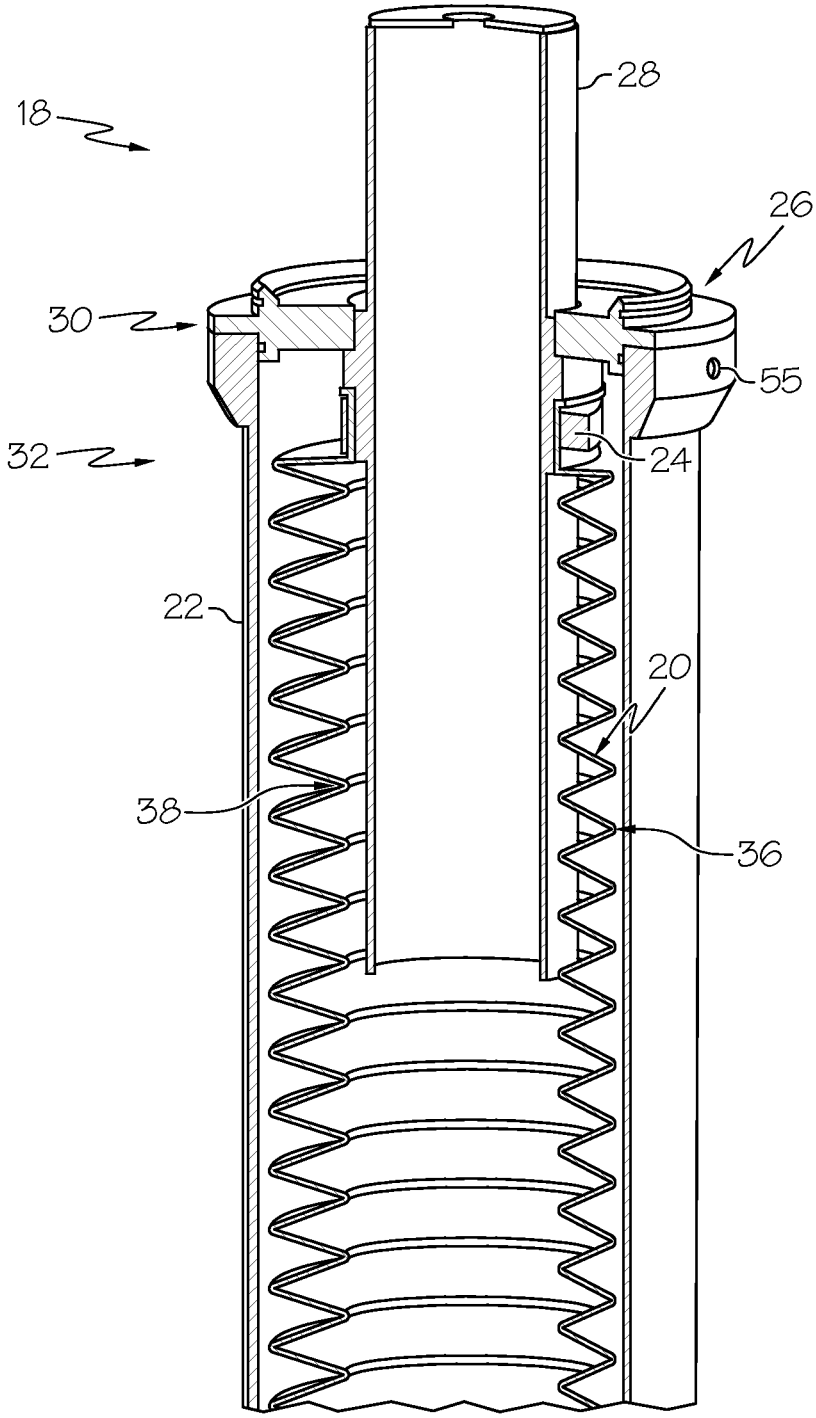
FIG. 3 is a magnified cross-sectional view of the connecting end of a compensator assembly according to the embodiments illustrated in FIGS. 2A and 2B.

Referring next to FIGS. 2A, 2B and 3, the compensator assembly 18 comprises a compensator 20 and a compensator housing 22. In high temperature environments (such as those encountered in deepwell geothermal environments), the material forming compensator 20 is of significant importance. The present inventors have found that polymeric materials, such as PTFE and related engineered materials, possess desirable elastomeric properties, and that some (including PTFE), by virtue of retaining these properties at high temperature, are particularly well-suited to forming the compensator 20, resulting in a robust bellow-bladder with a heat resistance of up to about 260° C. Furthermore, PTFE has very low pre-stressing that enables one or more compensators 20 made therefrom to avoid over-pressurization in the motor 14 across the motor's mechanical seal (not shown). In their elastomeric form, the compensators 20 also are easily movable within the compensator housing 22 to avoid canting and related lateral anomalies at the compensator 20 free (or floating) end 34. The compensator assembly (or assemblies) 18, because of their modular construction, may be easily put together, used and serviced, as well as permit a separate draining thereof. The compensator 20 is operable to contain motor cooling liquid and generally is substantially filled with motor cooling liquid to avoid any appreciable amount of air therein. While the compensator 20 in its preferred form is made at least primarily from PTFE, it is contemplated that other elastomers may be used in addition to, or in the alternative of, PTFE. The elastomers defining the compensator 20 are suitable for deepwell applications where environmental conditions generally involve high temperatures and high pressures.

By having a low degree of pre-stressing in conjunction with this high-temperature capability, the compensator 18 may reliably balance the pressure applied to an exterior surface of the motor 14 by the surrounding deepwell environment and the cooling and lubricating fluid pressure of the interior of motor 14, thereby ensuring low pressure differential operation even at the water depths discussed above. By maintaining this low pressure differential, the compensator 18 extends the reliable operating life of the mechanical seal within the motor 14, as well as enables the use of less robust (and therefore lighter weight) walls and related components for the motor housing 15, through (for example) decreased wall thickness of the motor housing 15 and related structure. In addition, should the mechanical seal of the motor 14 leak, the compensator 18 may serve as a reservoir for accommodating or balancing the leakage losses.

The compensator housing 22 encloses one or more of the compensators 20. Further, the compensator housing 22 generally is substantially rigid so as to guide and restrict the expansion and contraction of the compensator 20 along the substantially elongate dimension of the compensator housing 22. In one form, the rigidity of the compensator housing 22 comes from the use of metal, which helps to minimize friction between the compensator housing 22 and the compensator 20 with expansion and contraction thereof, as described herein.

The compensator housing 22 includes at its upper end a flange 26, through which a conveying tube 28 extends in a generally axial direction. The flange 26 is disposed proximally to or at a connecting end 30 of the compensator housing 22, and is operable to connect to a port of the submersible motor 14 so that the compensator assembly 18 may be secured to the submersible motor 14. Various securing devices 24, such as one or more clamps, may be utilized to secure a connection of the flange 26 to the port of the submersible motor 14. The conveying tube 28, which in a preferred (although not necessary) form is cylindrical, may pass partially through and be affixed or otherwise secured to an aperture formed in the flange 26. Likewise, the conveying tube 28 can be secured elsewhere at or near the connecting end 30 of the compensator housing 22. As such, with connection of the flange 26 to the submersible motor 14, the conveying tube 28 is partially inserted into each of the submersible motor 14 and the compensator 20 enclosed in the compensator housing 22 to convey motor cooling liquid therebetween.

The compensator 20 comprises an engaging end 32, a floating end 34, and a series of alternating crests 36 and grooves 38. The engaging end 32 is generally coextensive with the connecting end 30 of the compensator housing 22 and is operable to engage an exterior surface of the conveying tube 28, as shown with particularity in FIG. 3. One or more securing devices 24, such as, but not limited to, clamps, clasps or the like, may be used to secure an engagement between the compensator engaging end 32 and the conveying tube 28. Thus, the engaging end 32 of the compensator 20 is open, or at least partially open, with a diameter sufficient to receive on an inner surface thereof an end of the conveying tube 28. This permits motor cooling liquid in the submersible motor 14 to pass through the channel of the conveying tube 28 and into the elastomeric compensator 20.

As shown with particularity in FIG. 2A, the floating end 34 of the elastomeric compensator is free to move along the axial dimension of the compensator housing 22 in accordance with thermal expansion and contraction of the motor cooling fluid contained in the compensator 20. In this embodiment, the floating end 34 is sealed to prevent passage of motor cooling fluid therethrough and out of the compensator 20.

Figure 4:
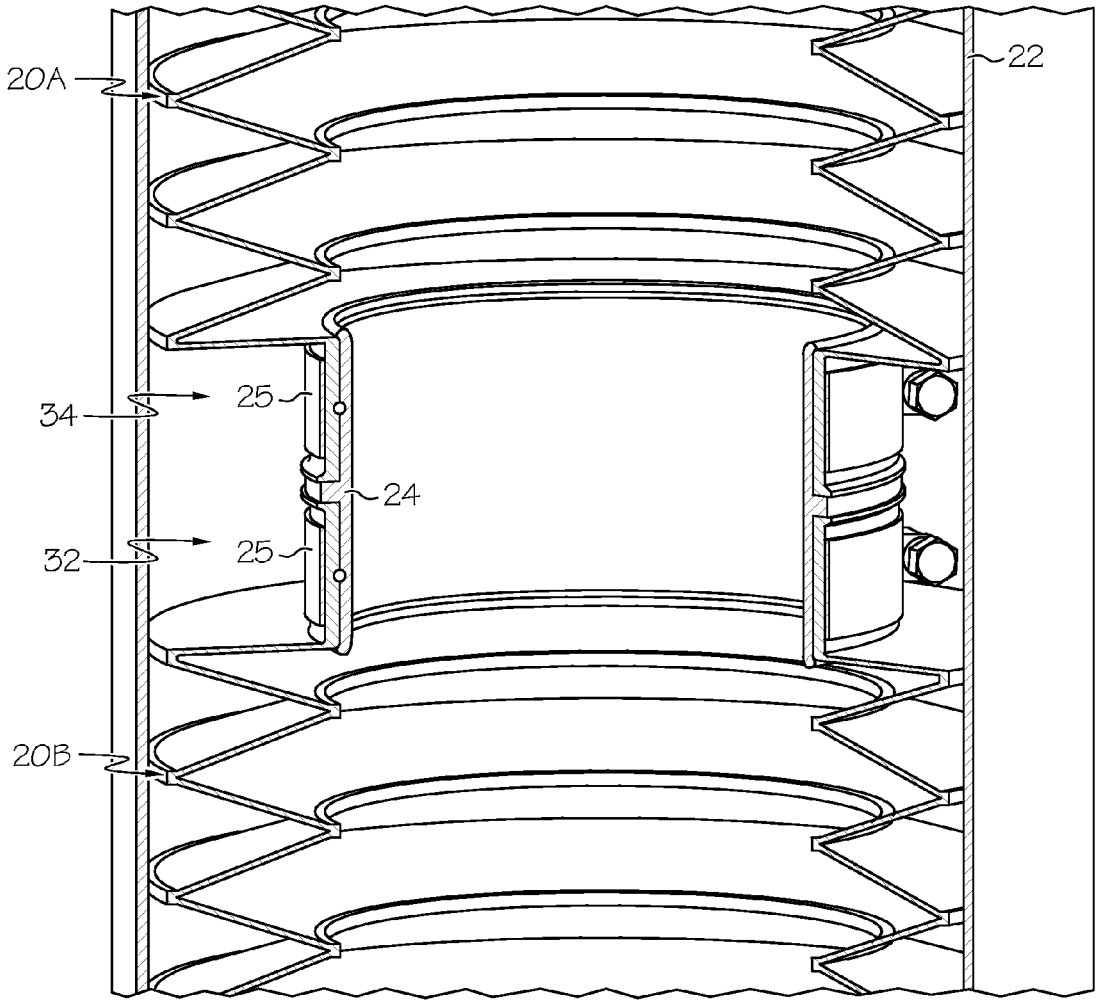
FIG. 4 is a cross-sectional view of a securing device securing an engagement of two elastomeric compensators according to another embodiment of the present invention.

The present inventors also contemplate that the compensator assembly 18 may comprise multiple compensators 20, for example, in situations where higher fluid pumping outputs and large motors are needed. Referring next to FIG. 4, another embodiment where multiple compensators 20A, 20B are serially attached to one another is shown. In this embodiment, the floating end 34 of at least the topmost compensator 20A is at least partially open to permit passage of motor cooling liquid therethrough and is operable to engage an engaging end 32 of another compensator 20B. In the situation where multiple compensators 20A, 20B are used, they may be interconnected in sequence as shown to accommodate larger volumes of motor cooling liquid, as well as larger variations in internal pressure that may be necessary or associated with larger, high power submersible motors 14. While the present inventors contemplate that any number of compensators 20 may be interconnected, for simplification purposes, references made herein are limited to exemplary embodiments with just first and second compensators 20A and 20B. In embodiments comprising multiple compensators 20, the compensator assembly 18 may use one or more securing devices to couple the sequential ends of adjacent compensators 20A, 20B.

Figure 6:
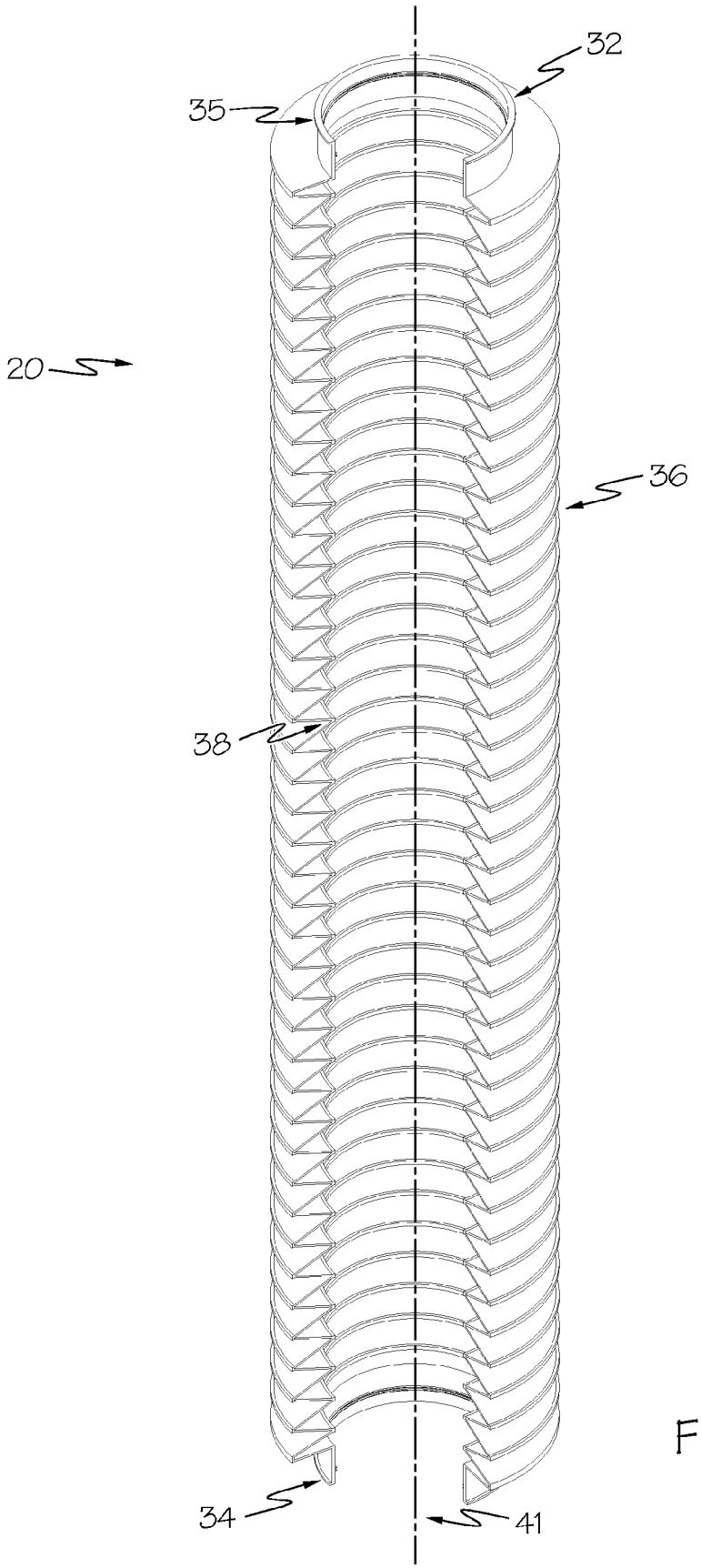
FIG. 6 is a sectional view of an elastomeric compensator according to another embodiment of the present invention.
Figure 7:
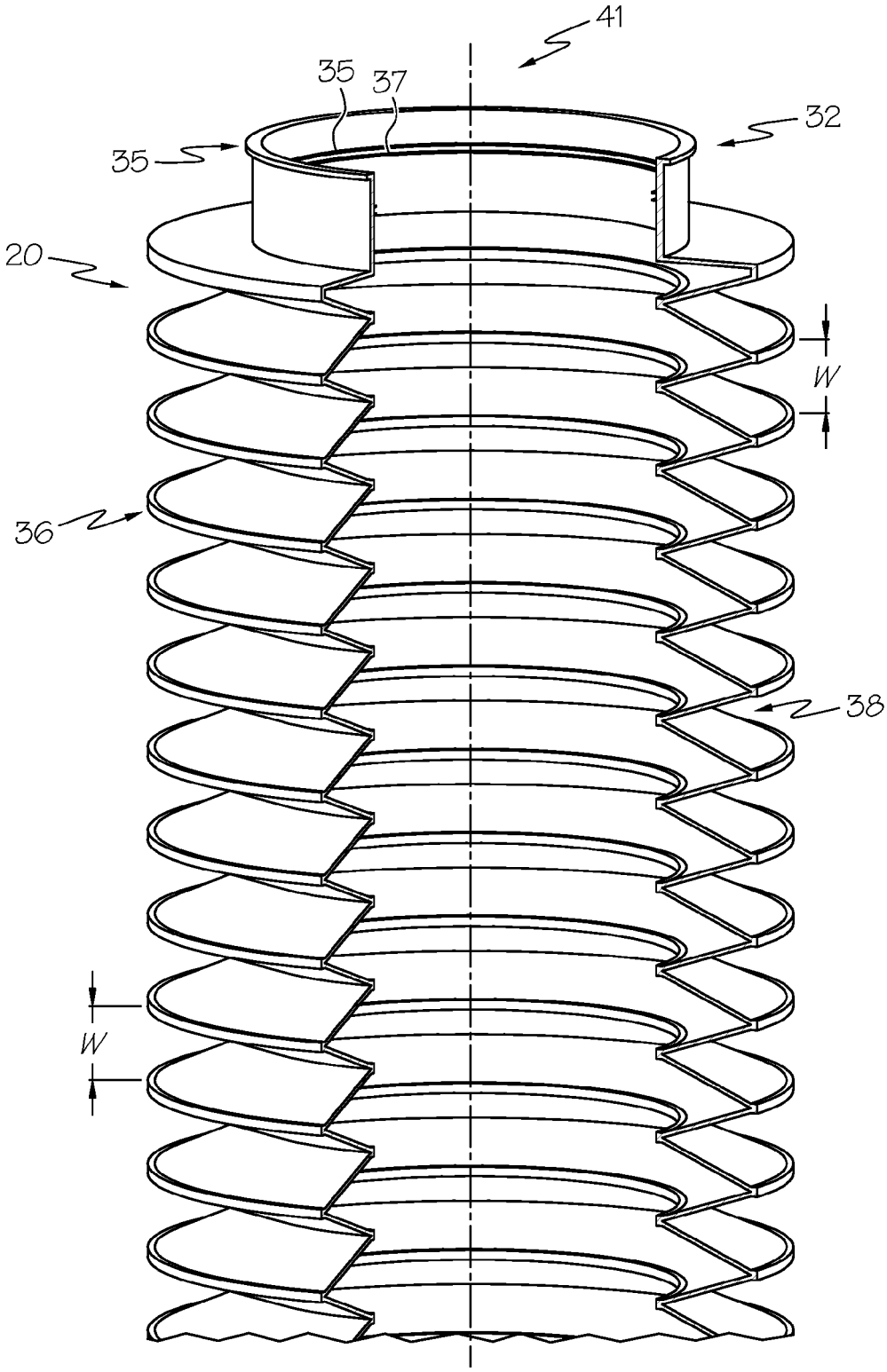
FIG. 7 is a sectional view of the elastomeric compensator of FIG. 6.

Referring next to FIGS. 6 and 7 in conjunction with FIG. 4, such a securing device to facilitate an engagement of a compensator 20A to the compensator housing 22 or to another compensator 20B is shown. As shown in FIG. 4, the securing device is in the form of a solid stainless steel sleeve 24 with adjustable clamps 25. Sleeve 24 is used as a inner surface flowpath collar so that upon axial coupling of the two compensators 20A and 20B therewith and subsequent tightening with clamps 25, the respective ends 34 and 32 of compensators 20A and 20B can be secured to one another to form a substantially leak-free fluid coupling. Screws on clamps 25 facilitate the tightening used to ensure secure coupling. Optionally, the ends 32, 34 of compensators 20A, 20B may include complementary interlocking ridges (or flanges) 35 and complementary recesses 37 to facilitate axial connection therebetween.

In the multi-compensator embodiment, an engaging end 32 of a first 20A of the multiple compensators 20 engages the compensator housing 22, while a floating end 34 of the first compensator 20A is free to move axially within the compensator housing 22. As mentioned above, the floating end 34 of the first compensator 20A is at least partially open to permit passage of motor cooling liquid therethrough and into an engaging end 32 of a second 20B of the multiple compensators 20. As such, the engaging end 32 of the second compensator 20B floats within the compensator housing 22 via its connection with the floating end 34 of the first compensator 20A. In addition, the floating end 34 of the second compensator 20B also is free to move axially within the compensator housing 22. Thereby, the floating end 34 of the first compensator 20A and both the engaging end 32 and the floating end 34 of the second compensator 20B move within the compensator housing 22 in response to thermal expansion and contraction of the motor cooling fluid contained in the compensators 20A and 20B.

Movement of the compensator 20 within the housing 22 of assembly 18 is enabled by the series of alternating crests 36 and grooves 38 that extend annularly at least partially along the longitudinal axis 41 of the compensator 20. The alternating crests 36 and grooves 38 cooperate to cause the compensator 20 to expand and contract with a bellows-like movement. Each groove 38 comprises a width w that defines a separation between sequential crests 36. Generally, but not necessarily, in a relaxed state where the compensator 20 is neither expanded nor contracted, the grooves 38 within the series have a uniform, or at least substantially uniform, width w, as shown with particularity in FIGS. 6 and 7. This width w may vary according to desired dimensions or design of the compensator 20 or the pressure-compensating needs of the submersible motor 14. For example, in one embodiment, the width w of the grooves 38 in a relaxed state (i.e., under neither expansion nor contraction equals about 4 to 5 millimeters (with a preferred size of about 4.6 millimeters, while, in another embodiment applicable to a larger motor 14, the width w of the grooves 38 in a relaxed state equals about 10 millimeters.

With thermal expansion of the motor cooling liquid, pressure builds up within the submersible motor 14 and the elastomeric compensator 20. The build up in internal pressure causes the compensator 20 to expand to compensate for the increased pressure and substantially prevent over-pressurization of the submersible motor 14. Due to the degree of elasticity of the compensator 20, the width w of any one or more of the grooves 38 may expand. Often, such expansion is generally to an extent necessary to compensate for an increased pressure in the submersible motor 14. For example, in the smaller embodiment discussed in the previous paragraph above, and depending on the heat increase in the motor and lubricating oil, the width w for a single groove 38 may expand from between about 4.6 millimeters to a maximum expansion of between about 25 millimeters and about 35 millimeters. Conversely, with contraction of the motor cooling liquid, pressure within the submersible motor 14 and the compensator 20 decreases. The decrease in internal pressure allows the compensator 20 to contract to maintain an adequate or desirable liquid pressure within the submersible motor 14. Due to the degree of elasticity of the compensator 20, the width w of any one or more of the grooves 38 may contract, generally to an extent necessary to compensate for a decreased pressure in the submersible motor 14.

Thus, it follows that, as the width w of the grooves 38 expands and contracts, the separation between one or more of the crests 36 increases and decreases accordingly. This results in movement of one or more of the crests 36 relative to the interior wall of the compensator housing 22. The compensator 20 generally is positioned within the compensator housing 22 such that the crests 36 of the compensator 20 are in contact, or at least close proximity, with the interior wall (or walls) of the compensator housing 22. Contact between the crests 36 and the interior wall of the compensator housing 22 generally is slight and therefore insufficient to hinder sliding of the crests 36 along the wall, yet is sufficient to substantially prevent radial or horizontal expansion of the compensator 20. In addition, sliding friction between the crests 36 sliding along the interior wall of the compensator housing 22 generally is minimal, mostly due to a low coefficient of friction between the PTFE crests 36 of the compensator 20 and the metal of the interior wall of the compensator housing 22. This in turn facilitates sliding movement of the floating end 34 of compensator 20 along the interior wall of the compensator housing 22 as the width w and grooves 38 expand and contract. Further, because of the rigid nature of the compensator housing 22, it substantially restricts expansion and contraction of the compensator 20 to along the housing longitudinal axis 41.

Referring again to FIGS. 2A, 2B and 3, the end of the conveying tube 28 received by the engaging end 32 of the compensator 20 defines a point of maximum contraction of the compensator 20 past which the floating end 34 cannot move. More particularly, the end of the conveying tube 28 within the compensator 20 obstructs the floating end 34 from further movement, thereby preventing any more contraction of the compensator 20. Further, the end 42 of the compensator housing 22 opposite of the connecting end 30 defines a point of maximum expansion of the compensator 20 past which the floating end 34 cannot move. More particularly, the opposite end 42 of the compensator housing 22 obstructs the floating end 34 from further movement, thereby preventing any further expansion of the compensator 20. A drain plug 40 may be provided on the compensator 20 to facilitate draining motor cooling liquid from it and the motor 14. Although shown in FIG. 2A as being situated at the bottom of the floating end 34, it will be appreciated by those skilled in the art that other locations at or near the bottom may also be suitable for conventional draining.

Figure 5:
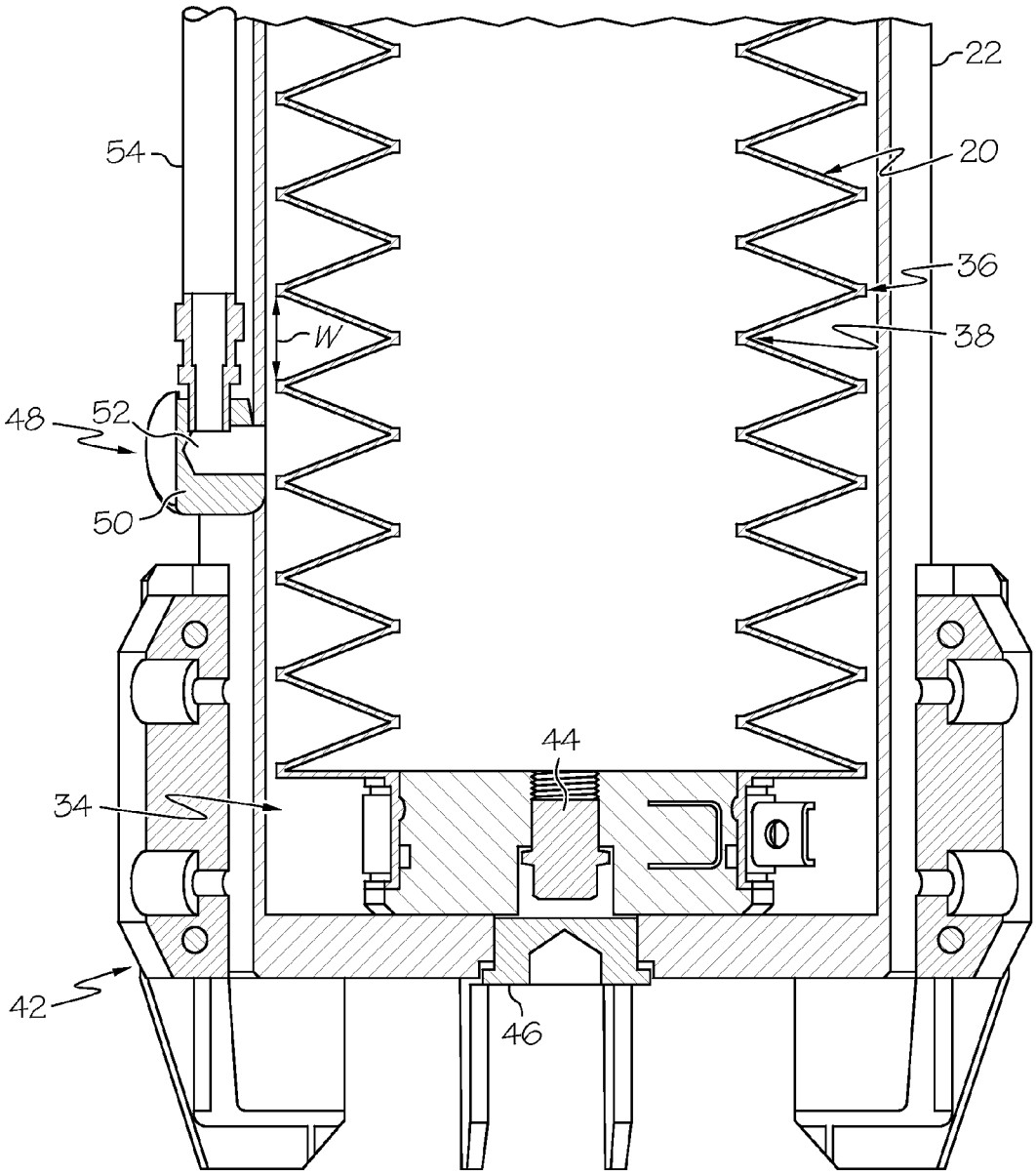
FIG. 5 is a magnified cross-sectional view of the end of the compensator assembly opposite of the connecting end of FIG. 3.

Referring next to FIG. 5 in conjunction with FIG. 2B, it should be noted that the present inventors also contemplate that the floating end 34 may be engaged to the end 42 of the compensator housing 22 opposite of the connecting end 30, rather than axially moveable floating end 34 shown in FIG. 2A and described above. In such an embodiment, the compensator assembly 18 may be configured such that the engaging end 32, while maintaining an engagement about the exterior surface of the conveying tube 28, may slide along the length of the conveying tube 28 with expansion and contraction of the width w of at least one of the grooves 38 with the floating end remains fixed in its engagement to the opposite end 42 of the compensator housing 22. The conveying tube 28 may comprise a ridge or other feature to prevent the engaging end 32 from sliding off of the conveying tube 28 with contraction of the compensator 20.

Further, in such embodiment as that of FIGS. 2B and 5, where the floating end 34 is secured to the opposite end 42 of the compensator housing 22, the floating end 34 generally is open with a diameter sufficient for the floating end 34 to receive a portion of the opposite end 42 of the compensator housing 22. As with drain plug 40 that is discussed above in conjunction with FIG. 2A, a drain plug 44 may be incorporated into this portion of the compensator housing 22 inserted into the floating end 34 so as to permit a draining of the motor cooling liquid from within the compensator 20. A secondary housing drain plug 46 also may be provided to substantially prevent inadvertent draining of the motor cooling liquid from the compensator 20.

In the embodiment of FIG. 2A, where the floating end 34 is not fixed (i.e., such that it moves relatively freely along the axial dimension of the housing 22), it ascends within the compensator housing 22 with contraction of the motor cooling liquid and descends within the compensator housing 22 with expansion of the motor cooling liquid. In the embodiment of FIG. 2B, where the floating end 34 is engaged to the opposite end 42 of the compensator housing 22, the engaging end 32 of the compensator 20 ascends within the housing 22 along the conveying tube 28 with expansion of the motor cooling liquid and descends within the housing 22 along the conveying tube 28 with contraction of the motor cooling liquid.

The present inventors also contemplate that the compensator assembly 18 may be provided to a top end or a side of the motor 14. Further, in multi-motor submersible pump systems 10, a compensator assembly 18 may be provided for each motor 14 of the system 10. Thus, a compensator assembly 18 may be connected to a submersible motor 14 at the connecting end 30 of the compensator housing 22 for liquid passage there-between and connected to another motor 14 or compensator assembly 18 at the opposite end 42 of the compensator housing 22.

In addition, as shown in FIG. 5, the compensator assembly 18 also may comprise a pressure balancing line 48 comprising a bracket 50, a welded elbow 52 to connect the compensator housing 22 to a tube (or pipe) 54 that extends up to the top of the motor housing 15. The pressure balancing line 48 is operable to control release of over-pressurized air or liquid from within the compensator housing 22 to outside of the compensator housing 22. For example, with expansion of the compensator 20, air present within the compensator housing 22 is compressed. As such, the compensator assembly 18 is preferably filled to make them substantially air-free while in a vertical (or almost vertical) position through a connection from the lower end of the motor 14. Likewise, the open space between the compensator housing 22 and the bellows of compensator 20 can also be filled through the balancing line 48, preferably at least until the upper drain/vent bore 55 formed in the connecting end 30 of the compensator housing 22 shows that it is substantially air-free, after which the assembly 18 is then plugged up. To keep this balancing line 48 filled during transport, the upper end is fluidly connected to a small prefilled tank (not shown) that is then removed before putting the assembly 18 into the well.

During operation, when the compression of the air exceeds a predetermined level, then the balancing line 48 permits the release of air from the compensator housing 22, and out through the tube 54. The present inventors contemplate that the tube 54 may release the liquid directly into the well environment or may route the liquid to another area of the compensator assembly 18, submersible motor 14 or submersible pump 12. Also, the pressure balancing line 48 may be operable to control intake of well water or related liquid into the compensator housing 22. Such action compensates for reduction of pressure within the compensator housing 22 that may occur with contraction of the elastomeric compensator 20 so as to substantially prevent creation of a vacuum, as well as against overpressure as the compensator 20 expands during heating of the motor oil within the compensator housing 22. The present inventors also contemplate that a pressure balancing line 48 may be provided to the compensator 20 to allow shuttling of the motor cooling liquid back and forth to the top of the motor 14 housing or outside of the submersible pump system 10.

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "primarily," "significantly," and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A submersible pump system comprising:

a submersible pump;

a submersible motor coupled to said pump to provide power thereto; and a compensator assembly comprising:

at least one longitudinally extending compensator in fluid communication with a supply of motor cooling liquid used in said motor, said at least one compensator comprising an engaging end, a floating end and a series of alternating crests and grooves extending along a longitudinal axis between said engaging and floating ends;

a compensator housing disposed about said at least one compensator, said compensator housing comprising a proximal end and a remote end, said proximal end comprising a flange configured to connect said compensator housing to said motor and a conveying tube insertable into each of said motor and said at least one compensator to establish motor cooling liquid communication there between, said conveying tube defining a maximum amount of contraction of said at least one compensator past which said floating end cannot move, said remote end of said at least one compensator defining a point of maximum expansion past which said floating end cannot move, wherein said at least one compensator is possessive of a degree of elasticity sufficient for a width of at least one of said grooves to expand and contract in response to respective thermal expansion and contraction of said motor cooling liquid contained within at least one of said motor and said at least one compensator, said crests configured to contact an interior wall of said compensator housing to a degree sufficient to prevent a sliding of said crests along said interior wall and movement of said floating end relative to said engaging end with expansion and contraction of said width of the at least one of said grooves; and a pressure balancing line operable to control shuttling of said motor cooling liquid back and forth between said compensator and said motor.

2. The submersible pump system of claim 1, wherein said compensator housing substantially restricts expansion and contraction of said at least one compensator to along said longitudinal axis.

3. The submersible pump system of claim 1, wherein said floating end of said at least one compensator is sealed to prevent passage of motor cooling liquid therethrough.

4. The submersible pump system of claim 1, wherein said floating end of said at least one compensator is at least partially open to permit passage of motor cooling liquid therethrough and is operable to engage an engaging end of another compensator.

5. The submersible pump system of claim 4, wherein said compensator assembly further comprises a securing device to secure said floating end of said at least one compensator and said engaging end of said another compensator.

6. The submersible pump system of claim 1, wherein said at least one compensator is configured primarily of polytetrafluoroethylene.

7. The submersible pump system of claim 1, wherein said compensator housing is configured primarily of metal.

8. The submersible pump system of claim 1, wherein said at least one compensator comprises a heat resistance of at least about 260° C.

9. The submersible pump system of claim 1, wherein said at least one compensator further comprises a drain plug to allow motor cooling liquid removal from said at least one compensator.

10. The submersible pump system of claim 1, wherein said compensator housing further comprises a housing drain plug to allow motor cooling liquid removal from said compensator housing.

11. The submersible pump system of claim 1, wherein said compensator assembly further comprises a pressure balancing line operable to control release of a gaseous fluid from within said compensator housing to outside of said compensator housing.

12. A submersible pump system comprising a submersible pump, a submersible motor, and a compensator assembly, wherein:

said compensator assembly comprises multiple longitudinally extending elastomeric compensators to contain a motor cooling liquid, a compensator housing to enclose said elastomeric compensators, and at least one device for securing said elastomeric compensators to one another within said compensator housing;

said compensator housing comprising a proximal end and a remote end, a flange disposed at said proximal end and a conveying tube partially insertable into each of said submersible motor and a first of said elastomeric compensators to convey a motor cooling liquid therebetween, said flange configured to connect said compensator assembly to said submersible motor;

said elastomeric compensators respectively comprise an engaging end to engage said flange, a floating end to float within said compensator housing, and a series of alternating crests and grooves extending annularly at least partially along a longitudinal axis of said respective elastomeric compensator;

said floating end of said first of said elastomeric compensators is at least partially open to permit passage of motor cooling liquid therethrough and is operable to engage said engaging end of a second of said elastomeric compensators;

said at least one device for securing is operable to secure an engagement between said first of said elastomeric compensators and said second of said elastomeric compensators;

said elastomeric compensators respectively comprise a degree of elasticity sufficient for a width of at least one of said respective grooves to expand and contract with thermal expansion and contraction, respectively, of said motor cooling liquid contained therein;

said respective crests contact an interior wall of said compensator housing with a coefficient of friction therebetween insufficient to prevent a sliding of said respective crests along said interior wall and movement of said respective floating ends relative to said engaging end of said first of said elastomeric compensators with expansion and contraction of said width of said at least one of said grooves;

said conveying tube received by said engaging end of said first of said elastomeric compensators defines a point of maximum contraction of said elastomeric compensators past which said floating end of said first of said elastomeric compensators cannot move; and an end of said compensator housing opposite of said connecting end defines a point of maximum expansion of said elastomeric compensators past which said floating end of said second of said elastomeric compensators cannot move.

13. The submersible pump system of claim 12, wherein said floating end of said second of said elastomeric compensators is sealed to prevent passage of motor cooling liquid therethrough.

14. The submersible pump system of claim 12, wherein at least one of said elastomeric compensators further comprises a drain plug to allow motor cooling liquid to be removed therefrom.

15. The submersible pump system of claim 12, wherein said compensator housing further comprises a housing drain plug to allow motor cooling liquid to be removed from said compensator housing.

16. The submersible pump system of claim 12, wherein said compensator assembly further comprises a pressure balancing line operable to control release of a gaseous fluid from within said compensator housing to outside of said compensator housing.

17. The submersible pump system of claim 12, wherein said elastomeric compensators are configured primarily of polytetrafluoroethylene and said compensator housing is configured primarily of metal.

18. A compensator assembly comprising multiple longitudinally extending elastomeric compensators, a compensator housing, and at least one securing device, wherein:

said compensator housing is operable to enclose said elastomeric compensators and comprises a flange and a conveying tube, said flange disposed proximally to a connecting end of said compensator housing to connect to a motor and said conveying tube partially insertable into each of said motor and a first of said elastomeric compensators to convey a motor cooling liquid there-between;

said elastomeric compensators respectively comprise an engaging end to engage said flange, a floating end to float within said compensator housing, and a series of alternating crests and grooves extending annularly at least partially along a longitudinal axis of said respective elastomeric compensator;

said floating end of said first elastomeric compensator is at least partially open to permit passage of motor cooling liquid therethrough and is operable to engage said engaging end of a second elastomeric compensator;

said securing device is operable to secure an engagement between said first elastomeric compensator and said second elastomeric compensator;

said elastomeric compensators respectively comprise a degree of elasticity sufficient for a width of at least one of said respective grooves to expand and contract with thermal expansion and contraction, respectively, of said motor cooling liquid contained therein;

said respective crests contact an interior wall of said compensator housing with a coefficient of friction therebetween insufficient to prevent a sliding of said respective crests along said interior wall and movement of said respective floating ends relative to said engaging end of said first elastomeric compensator with expansion and contraction of said width of said at least one of said grooves;

said conveying tube received by said engaging end of said first elastomeric compensator defines a point of maximum contraction of said elastomeric compensators past which said floating end of said first elastomeric compensator cannot move; and an end of said compensator housing opposite of said connecting end defines a point of maximum expansion of said elastomeric compensators past which said floating end of said second elastomeric compensator cannot move.

19. The compensator assembly of claim 18, wherein said elastomeric compensators are configured primarily of polytetrafluoroethylene and said compensator housing is configured primarily of metal.

20. The compensator assembly of claim 18, wherein said floating end of said second elastomeric compensator is sealed to prevent passage of motor cooling liquid therethrough.

* * * * *

UNITED STATES PATENT AND TRADEMARK OFFICE

CERTIFICATE OF CORRECTION

PATENT NO. : 8,430,649 B2
APPLICATION NO. : 12/622831
DATED : April 30, 2013
INVENTOR(S) : Thomas Albers et al.

It is certified that error appears in the above-identified patent and that said Letters Patent is hereby corrected as shown below:

In the Specification

Col. 7, Line 32, "used as a inner" should read --used as an inner--; and

In the Claims

Col. 11, Claim 1, Line 48, "sufficient" should read --insufficient--.

Signed and Sealed this
Twenty-ninth Day of October, 2013

Teresa Stanek Rea
*Deputy Director of the United States Patent and Trademark Office*